US005976319A

United States Patent [19]

Paju et al.

[11] Patent Number: 5,976,319

[45] Date of Patent: Nov. 2, 1999

[54] DISRUPTING THE FLOW FROM THE SMELT SPOUT OF A RECOVERY BOILER

[75] Inventors: Raimo Paju; Jukka Savolainen; Markku Tanttu, all of Varkaus, Finland

[73] Assignee: Ahlstrom Machinery Oy, Helsinki, Finland

[21] Appl. No.: 08/979,307

[22] Filed: Nov. 26, 1997

[30] Foreign Application Priority Data

Dec. 20, 1996 [FI] Finland ..... 960633 U

[51] Int. Cl.[6] ..... D21C 11/12

[52] U.S. Cl. ..... 162/30.1; 162/30.11; 422/187; 422/207

[58] Field of Search ..... 162/30.1, 30.11, 162/29; 422/207, 185; 423/DIG. 3; 239/335, 726

[56] References Cited

U.S. PATENT DOCUMENTS 4,421,596 12/1983 Hogberg ..... 162/30.11
5,204,069 4/1993 Paxton et al. ..... 422/185

FOREIGN PATENT DOCUMENTS 52-39575 3/1977 Japan .
7500236 12/1975 Sweden .

*Primary Examiner*—Dean T. Nguyen
*Attorney, Agent, or Firm*—Nixon & Vanderhye P.C.

[57] ABSTRACT

The intensity of explosions as a result of hot (750–820 degrees C.) smelt from a pulp mill recovery boiler impacting cool (70–100 degrees C.) liquid in a dissolving tank is minimized by more effectively disrupting the flow of smelt from a spout free end tip into the tank. First and second nozzles which issue jets of disrupting fluid (such as steam or green liquor) are positioned on opposite sides of the center line of the spout, and are positioned and spaced from the spout tip and each other so that the jet emanating from at least one of the nozzles always intersects the flow of smelt from the spout even though the smelt flow path varies during normal operation of the recovery boiler. The first and second nozzles are preferably each spaced from the spout free end tip a distance of between about 300–700 mm, but different by at least 50 mm from the other nozzle, and are positioned downwardly and obliquely at an angle to the vertical so that the jets move downwardly and obliquely making an angle of between about 20–40 degrees with respect to the vertical. Other nozzles—e. g. in front of the smelt flow—can also be provided within a hood covering the spout area.

20 Claims, 2 Drawing Sheets

DISRUPTING THE FLOW FROM THE SMELT SPOUT OF A RECOVERY BOILER

BACKGROUND AND SUMMARY OF THE INVENTION

The present invention relates to a method and system for disrupting the flow from the smelt spout secured to the wall of a recovery boiler in a cellulose pulp mill (e. g. a kraft pulp mill), utilizing at least two properly positioned nozzles for introducing a disrupting medium for breaking up the smelt discharged from the boiler via the spout into a dissolving tank placed under the spout.

An essential apparatus in the chemical recovery circulation of sulfate and other sodium-based pulp manufacturing processes is the recovery boiler, such as a soda recovery boiler. In the recovery boiler waste liquor (e. g. black liquor) from the pulping process is combusted in order to transform cooking chemicals in the waste liquor into a form suitable for the recovery process. In a sulfate process the most important chemicals are sodium and sulfur. Organic substances dissolved in the waste liquor during digestion are combusted in the boiler producing heat which is used to convert the inorganic compounds contained in the waste liquor back into chemicals to be used in the digestion, and also for the production of steam. The inorganic matter of the waste liquor., i.e. ash, melts in the high temperature of the boiler and runs down as a primarily liquid smelt to the bottom of the furnace.

In conventional recovery boilers, the smelt is taken from the bottom of the boiler along one or more cooled smelt spouts to a dissolving tank. In the dissolving tank the smelt is dissolved into water or weak white liquor to produce soda lye, i.e. green liquor. The main components of the smelt, and the green liquor produced from it, in a sulfate process are sodium sulfide and sodium carbonate. The green liquor is then transported to a causticizing plant for white liquor production.

Hot smelt flow causes "banging" and explosions when it falls into the liquid in the dissolving tank. The "banging" noise is caused by the explosive reaction between the smelt and water when the smelt contacts the green liquor in the dissolving tank. The temperature of the smelt is on the order of 750–820° C. and the temperature of the green liquor (or weak white liquor) in the dissolving tank, containing mainly water, is on the order of 70–100° C.

The intensity of the explosive reactions in the dissolving tank may be controlled by breaking up the smelt flow running down the spout into small streams, droplets, flows, or pieces before it contacts the green liquor in the dissolving tank. In most cases, the smelt is disintegrated by directing a jet stream of green liquor against the smelt flow discharged from the spout. Also a jet of mist containing air and water has been suggested for this purpose. In Finland, the smelt is most commonly broken up by using low or medium pressure steam. However, the breaking up of the smelt flow using such disrupting streams is often uncertain and incomplete particularly when the flow path of the smelt between the smelt spout and the liquid surface in the dissolving tank varies. The flow path depends on the flow volume and the temperature of the smelt and other operating conditions, which inherently vary from time-to-time.

The conventional stationary breaking nozzle used for introducing disrupting media does not take into account the changing flow path of the smelt. It has been suggested that the position of the conventional breaking nozzle structure may be adjusted automatically, but such an automatic position adjustment causes problems. There is no reliable method available for adjusting the direction of the breaking nozzles with the change of the smelt flow path and the smelt volume. In practice the nozzle position (and disrupting stream direction) must be adjusted manually. However this is a dangerous job, and it is not economical or practical to assign a worker to perform this task on a continuous basis. The imperfect breaking up of the smelt pieces results in smaller or larger explosions which often cause an almost continuous loud noise in the vicinity of the dissolving tank. Liquid and smelt splashes and exhaust gases are usually prevented from escaping into the environment by a hood surrounding the smelt spout.

Usually, an excess volume of steam must be directed continuously to the smelt flow in order to secure adequate disintegration of the largest momentary smelt flow volumes. Thus, large volumes of steam may be wasted, which impairs the economy of the recovery process.

Swedish published patent application no. 381 295 discloses a method of improving the disintegration of smelt. The proposal in this reference is to cover the upper part of the dissolving tank with a semi-spherical hood having a wall thereof penetrated by the smelt spout of the recovery boiler. The smelt flow discharged from the spout hits a disc-like disrupting member inside the hood. The smelt may be further broken up by liquid jets disposed symmetrically below the disrupting member in the upper portion of the dissolving tank. A drawback of the disc-like disrupting member is that the sticky smelt may collect on its surfaces and consequently the disrupting capacity of the member is impaired. It must be cleaned manually, and the smelt lumps dislodged by cleaning fall into the dissolving tank, increasing the number of explosions. Because of the hot and chemically aggressive smelt, the life of such a disrupting member is very short even if it is made of fire-proof steel.

Japanese patent application no. 52-39575 discloses an apparatus for scattering and smashing the smelt flow. At first, the smelt arriving from the smelt spout is disrupted in an ordinary manner—by a steam jet disposed in the upper part of the dissolving tank—to produce coarse granules which then hit a cloud of water drops from horizontal nozzles, and after that impact an oblique plate before the fine smelt particles drop into the liquid in the tank.

The present invention seeks to improve the efficiency and reliability of the breakup of smelt discharged from the smelt spout of a recovery boiler to the dissolving tank and thus to minimize the number of explosive reactions between water and smelt compared to all of the prior art discussed above, in a relatively simple and inexpensive manner. The invention pays particular attention to the problems caused by variations in the smelt flow.

In order to achieve the advantages sought, the invention utilizes at least two dispersing nozzles distributing the same dispersing medium and disposed at a distance from the free end of tile spout and on different sides of a line parallel with the center axis of the spout. The nozzles are directed to apply at least one dispersing medium jet at a time obliquely downwardly to intersect the path of the smelt flow running down from the spout and thus to secure substantially uninterrupted breakup of the smelt flow during the process irrespective of the changes in the flow path.

According to the present invention, a new type of a smelt disrupting apparatus and method have been developed to reduce the noise problem of the dissolving tank. There are two or more dispersing nozzles provided in the vicinity of the smelt spout below the level of the end of the spout and directed towards the smelt flow from at least two different directions. At least two dispersing nozzles are located at the sides of the smelt flow running down from the smelt spout at a distance from a line parallel with the center line of the smelt spout (from the center line of the smelt flow). There may be one or more nozzles on both sides.

The dispersing nozzles may be arranged approximately at an equal distance from the free end of the smelt spout whereby the dispersing jets intersect the flow path of the smelt flow approximately at the same level. Preferably the dispersion nozzles are, however, disposed at different distances from the lower tip of the smelt spout. This arrangement guarantees that at least one dispersion jet hits the smelt flow from the side although the flow path of the smelt flow changes with relation to the dispersion nozzles due to smelt flow volumes and other process changes.

An additional nozzle or nozzles may also be arranged at other points by methods known per se. For example there may be an additional nozzle in front of the smelt flow and directed against the smelt flow or obliquely downwardly against the smelt flow. The nozzle may also be above the smelt flow directed approximately vertically downwardly.

According to one aspect of the present invention, an assembly for handling fluid smelt from a pulp mill recovery boiler is provided comprising the following components: A smelt spout connected to a recovery boiler, and having a free end tip, and a center line, fluid smelt downwardly flowing along the center line from said free end tip of said spout; and first and second nozzles for directing disrupting media toward the flowing smelt. The first and second nozzles are positioned on opposite sides of said center line, and so that at least one of the vertical and horizontal positions of said nozzles are different from each other so that the disrupting medium emanating from at least one of said nozzles intersects the smelt flowing downwardly from said smelt spout free end tip during normal operation even though the flow path of the smelt varies.

The first and second nozzles may each be spaced horizontally, in the dimension of smelt flow, from the spout free end tip a distance between about 200–500 mm, and the first nozzle is spaced a horizontal distance different from the second nozzle by between about 50–200 mm. Also, the first and second nozzles may both be positioned vertically below the spout free end tip a distance of between about 150–250 mm, and vertically spaced from each other a distance of at least 10 mm. For example, the first and second nozzles are each spaced from the spout free end tip a distance between about 300–700 mm, and at least 50 mm different than the other nozzle. Also, the first and second nozzles may each be spaced horizontally, in a dimension perpendicular to smelt flow, from the center line a distance between about 100–200 mm, and preferably the first and second nozzles are each positioned downwardly and obliquely at an angle to the vertical so that media emanating moves downwardly and obliquely making an angle of between about 20–40 degrees with respect to the vertical.

A third nozzle may be provided, e. g. positioned horizontally in front of the spout in the direction of smelt flow, and directing disrupting medium therefrom in a horizontal direction substantially opposite to the horizontal component of the smelt flow.

According to another aspect of the present invention, a chemical recovery assembly is provided comprising the following components: A pulp mill recovery boiler having a smelt spout extending outwardly from a bottom portion thereof. A green liquor dissolving tank positioned beneath the smelt spout to receive smelt from the smelt spout therein; the smelt spout having a free end tip, and a center line, fluid smelt downwardly flowing along the center line from the free end tip of the spout. And first and second nozzles for directing disrupting media toward the flowing smelt, the first and second nozzles positioned on opposite sides of the center line, and so that the first and second nozzles are each spaced horizontally, in the dimension of smelt flow, from the spout free end tip a distance between about 200–500 mm, and the first nozzle is spaced a horizontal distance different from the second nozzle bof between about 50–200 mm. Other details of nozzle positioning may be provided as described above.

According to another aspect of the invention there is provided a method of dissolving smelt to form green liquor while minimizing explosions as a result of hot (e. g. about 750–820 degrees C.) smelt contacting cool (e. g. about 70–100 degrees C.) liquid, using: a recovery boiler having a smelt spout extending outwardly from a bottom portion thereof; the smelt spout having a free end tip, and a center line, fluid smelt downwardly flowing along the center line from the free end tip of the spout; and a dissolving tank positioned below the spout and having cool liquid therein. The method comprises the following steps:

(a) causing fluid smelt to flow downwardly from the free end tip of the spout toward the dissolving tank, the smelt flow path inherently varying during normal operation of the recovery boiler; and (b) before the smelt impacts the liquid in the dissolving tank, directing a disrupting medium in first and second distinct jets from opposite sides of the center line of the smelt flow toward the smelt flow to impact the smelt and break it into smaller flows, droplets, or pieces; and wherein step (b) is practiced so that the distinct jets are differently directed so that, in combination, the disrupting medium from at least one of the jets intersects the smelt flowing downwardly from the smelt spout free end tip during normal operation even though the flow path of the smelt varies.

Step (b) is also preferably practiced so that jets are continuously emanating from both sides of the spout centerline at the same time (although based upon visual or automatic determination of the smelt flow at any particular point in time one of the jets may be turned off); and step (b) is also preferably practiced by positioning first and second nozzles which issue the jets of disrupting medium so that the first and second nozzles are each spaced from the spout free end tip a distance of between about 300–700 mm, but different by at least 50 mm from the other nozzle, and are positioned downwardly and obliquely at an angle to the vertical so that the jets move downwardly and obliquely making an angle of between about 20–40 degrees with respect to the vertical.

It is the primary object of the present invention to provide a simple yet effective method and apparatus for optimally disrupting the flow of smelt into a dissolving tank even when the smelt flow rate is inconsistent, varying during normal and inherent process changes. This and other objects of the invention will become clear from an inspection of the detailed description of the invention, and from the appended claims.

DETAILED DESCRIPTION OF THE DRAWINGS

Figure 1:
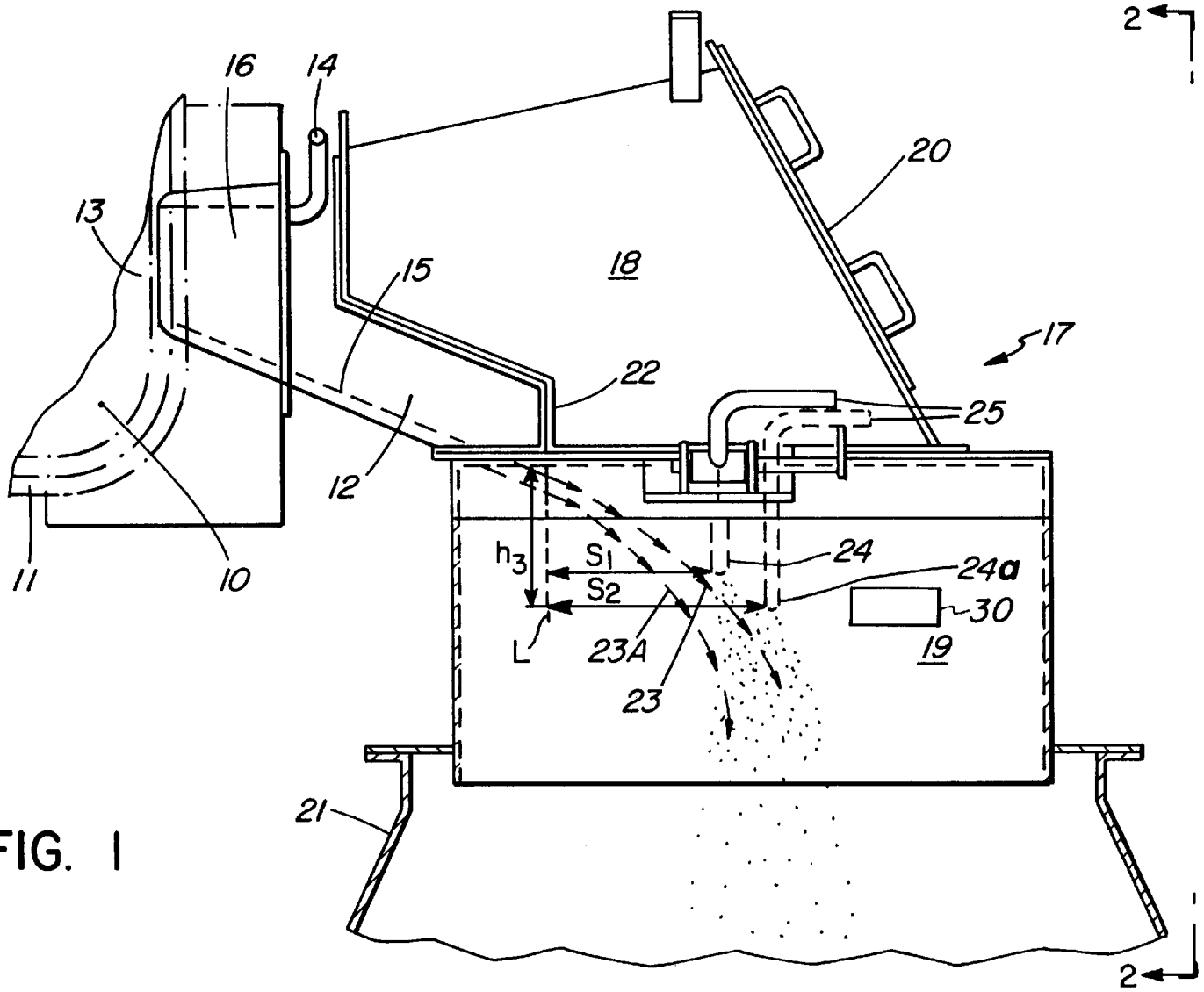
FIG. 1 is a a schematic side view, mostly in cross-section, but partly in elevation, of an exemplary smelt flow disrupting assembly according to a preferred embodiment of the invention.

In FIG. 1, a furnace formed by the lower part of a recovery boiler of a pulp mill is generally referenced by reference number 10. The walls and the bottom of this conventional recovery boiler are formed by water-cooled tubes 11. In the boiler wall formed by the tubes 11 immediately above the bottom of the furnace 10 is an opening 13. The conventional stationary end 16 of a smelt spout 12 is disposed in opening 13. The smelt spout 12 illustrated in the drawings has a jacket into which cooling medium is supplied and which is removed via connection 14. However, the invention is not limited to the smelt spout embodiment 12 illustrated but also other types of spouts (conventional or to be developed) may be used.

The portion of the smelt spout 12 extending outside the boiler wall 11 is surrounded by a conventional closed protecting hood 17 comprising an upper portion 18 and a lower portion 19. The upper portion 18 further comprises a cover 20. The purpose of the protecting hood 17 is to prevent liquid and smelt splashes and exhaust gases from being discharged into the surrounding environment. The lower portion 19 of the protecting hood 17 is connected to a conventional dissolving tank 21 disposed under the protecting hood 17, and in which the smelt is dissolved into liquid, producing green liquor.

The hot, fluid, smelt runs from the bottom of the furnace 10 via the opening 13 to the smelt spout 12, and along the bottom 15 of the spout 12 downwardly, falling and flowing from the free end tip 22 of the spout 12 into the dissolving tank 21. The smelt flow path is indicated by arrows 23 in FIGS. 1 and 2. As already described, the smelt flow path may change during normal operation of the recovery boiler, however, for example to that illustrated schematically by arrows 23*a* in FIG. 1.

In order to breakup the fluid smelt into smaller drops, according to the invention jets of disrupting medium are directed to smelt flow from both sides thereof using the first and second smelt flow nozzles 24, 24*a*, respectively. Typically the disrupting medium is low pressure or medium pressure steam (although other known disrupting media—such as weak white liquor or green liquor produced in the dissolving tank 21—may be used) supplied to the nozzles 24, 24*a* via connections/feed pipes 25.

Figure 2:
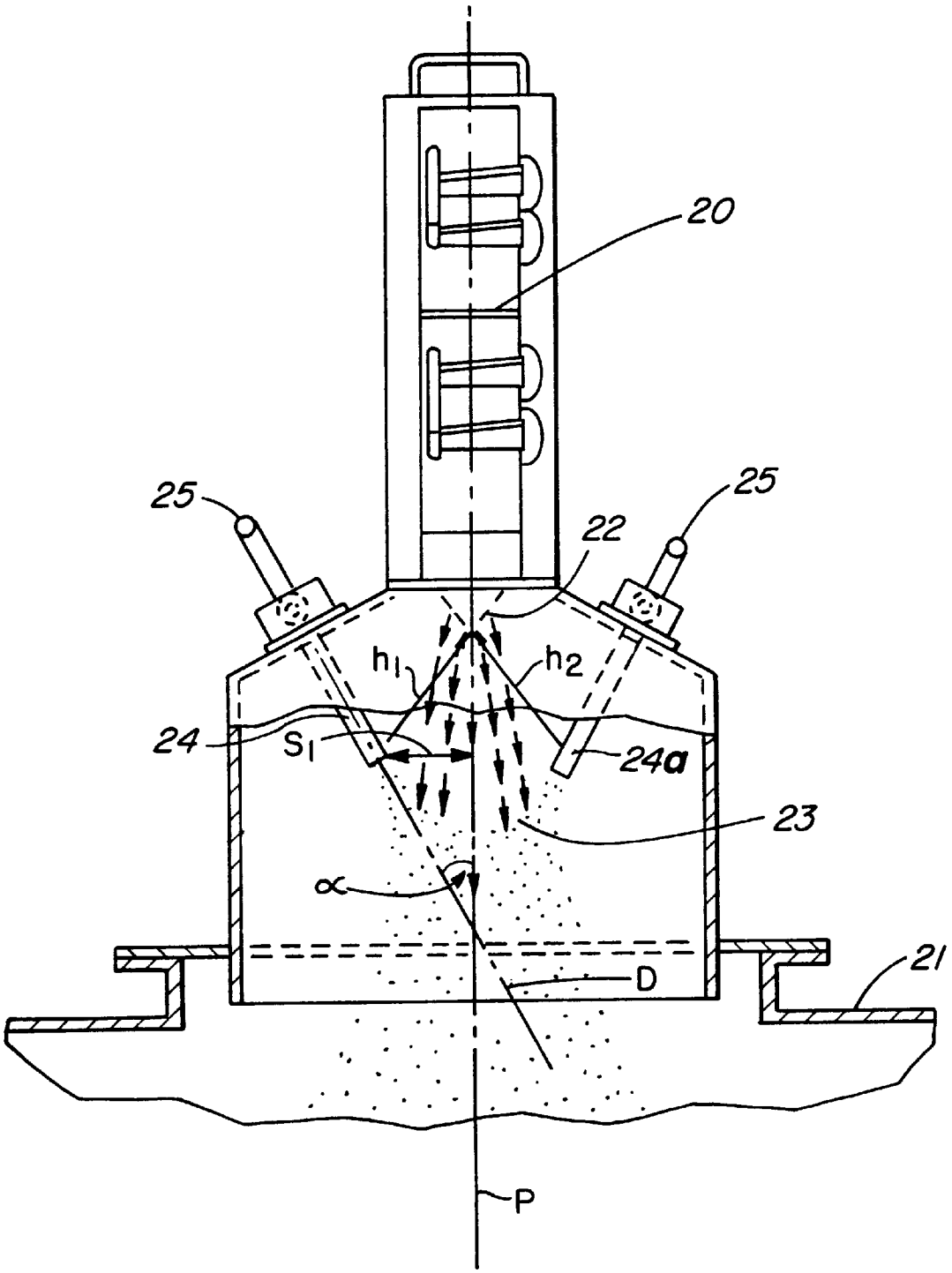
FIG. 2 is an end view, partly in cross-section and partly in elevation, of the assembly of FIG. 1 looking in along line 2—2 in FIG. 1.

The nozzle connections 25 are preferably mounted by (e.g. extending through and engaging) the protecting hood 17, for example in its lower portion 19, so that the nozzles 24, 24*a* may be turned in order to adjust the angle $\alpha$ between the direction D of the disrupting jet and the direction P of the smelt flow illustrated in FIG. 2. The disrupting medium feed pipes 25 may be adjusted in the oblique upright direction so that the vertical locations of the nozzles 24, 24*a* are optimized (with respect to the flows 23, 23*a*, and each other). Usually the angle $\alpha$ is adjusted to a position optimized for boiler start-up, after which daily adjustment is usually not necessary. Seen from the front of the smelt spout as in FIG. 2, the angle $\alpha$ is preferably between about 20° and about 40°, usually optimally about 30°. The angle $\alpha$ is normally the same for both the nozzles 24, 24*a*, although the angles $\alpha$ may be different.

The distance $S_1$ of the tip of the first disrupting nozzle 24 from the line P parallel with the center axis of the smelt spout 12 (and at the same time coextensive with the center line of the smelt flow 23), as illustrated in FIG. 2, is preferably about 100–200 mm but in some cases it may be shorter or longer than this. The tip of the disrupting nozzle is preferably about 150–250 mm (distance $h_3$, FIG. 1) vertically below the lower tip 22 of the smelt spout 12 from which the smelt drops (and preferably the nozzles 24, 24*a* are vertically spaced from each other at least 10 mm). The shortest direct distance between the tip of each of the nozzles 24, 24*a* from the lower tip 22 of the spout 12 is typically about 300–700 mm (distances $h_1$ and $h_2$, FIG. 2), but different by at least 50 mm from the other nozzle.

The horizontal spacing $s_2$ of the second nozzle 24*a* measured from the tip 22 of the smelt spout (from the plane L touching the tip 22 of the smelt spout 12 and being perpendicular to the longitudinal axis of the smelt spout 12) is preferably different than the spacing $s_1$. The distances $s_1$ and $s_2$—as seen in FIG. 1—are preferably each between about 200–500 mm, and the difference between the distances $s_1$ and $s_2$ is preferably between about 50 200 mm.

The nozzles 24, 24*a* have been positioned so that the disrupting jets emanating therefrom approach the smelt flow in path 23 from both sides, intersecting the path 23 and breaking-up the smelt into small drops which fall into the liquid in the dissolving tank 21 without causing a significant explosion.

Directing at least two disrupting jets (from nozzles 24, 24*a*) to the smelt flow 23 at the same time ensures that at least one jet continuously hits the smelt flow path even if the path rapidly changes (e. g. from 23 to 23*a*). A constant disrupting flow is even more certain if the nozzles 24, 24*a* are positioned at different distances from the lower tip 22 of the smelt spout 12, as illustrated in both FIGS. 1 and 2. Alternatively, the nozzles 24, 24*a* can be individually controlled (manually or automatically) so that only one is operating at a time if it is known (by visual observation, or by automatic sensing) which of the nozzles 24, 24*a* is positioned to most effectively disrupt the smelt flow at any particular time.

In addition to the two nozzle 24, 24*a* disrupting jets directed from the sides to the smelt flow path 23, the smelt disrupting system may also comprise other nozzles. The additional nozzles, if provided, may be disposed at the sides of the smelt flow (an preferably positioned differently than the nozzles 24, 24*a*), or in front of it (as illustrated schematically at 30 in FIG. 1), in which case the jet of disrupting media (from nozzle 30) is substantially opposite the direction of the smelt flow path 23.

With the apparatus and method of the present invention, the breakup of the smelt is more efficient and safer than in prior art systems and procedures. The danger of extensive explosions in the dissolving tank is reduced according to the invention, and at the same time the noise level in the vicinity of the dissolving tank is reduced significantly. Also, the smelt which has been disrupted dissolves more easily in the dissolving tank 21.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods and systems. In the following claims the distances indicated are from the nozzle tip (that part of the nozzle from which the disrupting medium emanates).

What is claimed is:

1. A method of dissolving smelt to form green liquor while minimizing explosions as a result of hot smelt contacting cool liquid, using: a recovery boiler having a smelt spout extending outwardly from a bottom portion thereof; the smelt spout having a free end tip, and a center line, fluid smelt downwardly flowing along the center line from the free end tip of said spout; and a dissolving tank positioned below the spout and having cool liquid therein; said method comprising the steps of:

(a) causing fluid smelt to flow downwardly from the free end tip of the spout toward the dissolving tank, the smelt flow path inherently varying during normal operation of the recovery boiler; and (b) before the smelt impacts the liquid in the dissolving tank, directing a disrupting medium in first and second distinct jets from opposite sides of the center line of the smelt flow toward the smelt flow to impact the smelt and break the smelt into smaller flows, droplets, or pieces; and wherein step (b) is practiced so that the distinct jets are differently directed so that, in combination, the disrupting medium from at least one of the jets intersects the smelt flowing downwardly from the smelt spout free end tip during normal operation even though the flow path of the smelt varies.

2. A method as recited in claim 1 wherein step (b) is practiced so that jets are continuously emanating from both sides of the spout centerline at the same time; and wherein step (b) is practiced by positioning first and second nozzles which issue the jets of disrupting medium so that the first and second nozzles are each spaced from the spout free end tip a distance of between about 300–700 mm, but different by at least 50 mm from the other nozzle, and are positioned downwardly and obliquely at an angle to the vertical so that the jets move downwardly and obliquely making an angle of between about 20–40 degrees with respect to the vertical.

3. A chemical recovery assembly comprising:

a pulp mill recovery boiler;

a smelt spout connected to the recovery boiler, and having a free end tip, and a center line, fluid smelt downwardly flowing along the center line from said free end tip of said spout; and first and second nozzles for directing disrupting media toward the flowing smelt;

said first and second nozzles positioned on opposite sides of said center line, and so that at least one of the vertical and horizontal positions of said nozzles are different from each other so that the disrupting medium emanating from at least one of said nozzles intersects the smelt flowing downwardly from said smelt spout free end tip during normal operation even though the flow path of the smelt varies.

4. An assembly as recited in claim 3 wherein said first and second nozzles are each spaced horizontally, in the dimension of smelt flow, from said spout free end tip a distance between about 200–500 mm, and said first nozzle is spaced a horizontal distance different from said second nozzle by between about 50–200 mm.

5. An assembly as recited in claim 4 wherein said first and second nozzles are both positioned vertically below said spout free end tip a distance of between about 150–250 mm.

6. An assembly as recited in claim 5 wherein said first and second nozzles are vertically spaced from each other a distance of at least 10 mm.

7. An assembly as recited in claim 6 wherein said first and second nozzles are each spaced from said spout free end tip a distance between about 300–700 mm.

8. An assembly as recited in claim 7 wherein said first and second nozzles are each spaced horizontally, in a dimension perpendicular to smelt flow, from said center line a distance between about 100–200 mm.

9. An assembly as recited in claim 8 wherein said first and second nozzles are each positioned downwardly and obliquely at an angle to the vertical so that media emanating moves downwardly and obliquely making an angle of between about 20–40 degrees with respect to the vertical.

10. An assembly as recited in claim 3 further comprising a third nozzle positioned horizontally in front of said spout in the direction of smelt flow, and directing disrupting medium therefrom in a horizontal direction substantially opposite to the horizontal component of the smelt flow.

11. An assembly as recited in claim 3 wherein said first and second nozzles are both positioned vertically below said spout free end tip a distance of between about 150–250 mm.

12. An assembly as recited in claim 11 wherein said first and second nozzles are vertically spaced from each other a distance of at least 10 mm.

13. An assembly as recited in claim 3 wherein said first and second nozzles are each spaced from said spout free end tip a distance between about 300–700 mm.

14. An assembly as recited in claim 3 wherein said first and second nozzles are each spaced horizontally, in a dimension perpendicular to smelt flow, from said center line a distance between about 100–200 mm.

15. An assembly as recited in claim 3 wherein said first and second nozzles are each positioned downwardly and obliquely at an angle to the vertical so that media emanating moves downwardly and obliquely making an angle of between about 20–40 degrees with respect to the vertical.

16. A chemical recovery assembly comprising:

a pulp mill recovery boiler having a smelt spout extending outwardly from a bottom portion thereof;

a green liquor dissolving tank positioned beneath said smelt spout to receive smelt from said smelt spout therein;

said smelt spout having a free end tip, and a center line, fluid smelt downwardly flowing along the center line from said free end tip of said spout; and first and second nozzles for directing disrupting media toward the flowing smelt;

said first and second nozzles positioned on opposite sides of said center line, and so that said first and second nozzles are each spaced horizontally, in the dimension of smelt flow, from said spout free end tip a distance between about 200–500 mm, and said first nozzle is spaced a horizontal distance different from said second nozzle of between about 50–200 mm.

17. An assembly as recited in claim 16 wherein said first and second nozzles are both positioned vertically below said spout free end tip a distance of between about 150–250 mm, and wherein said first and second nozzles are vertically spaced from each other a distance of at least 10 mm.

18. An assembly as recited in claim 16 wherein said first and second nozzles are each spaced from said spout free end tip a distance between about 300–700 mm; and wherein a vicinity adjacent said spout is covered by a hood, and said nozzles are positioned by fluid passageways connected to, and extending through, said hood.

19. An assembly as recited in claim 16 wherein said first and second nozzles are each spaced horizontally, in a dimension perpendicular to smelt flow, from said center line a distance between about 100–200 mm.

20. An assembly as recited in claim 16 wherein said first and second nozzles are each positioned downwardly and obliquely at an angle to the vertical so that media emanating moves downwardly and obliquely making an angle of between about 20–40 degrees with respect to the vertical.

* * * * *